US005820434A

United States Patent [19]

Itoh et al.

[11] Patent Number: 5,820,434

[45] Date of Patent: Oct. 13, 1998

[54] VACUUM AIRTIGHT ENVELOPE AND METHOD FOR MANUFACTURING SAME

[75] Inventors: Shigeo Itoh; Tatsuo Yamaura; Teruo Watanabe; Yoshio Makita; Akira Kadowaki, all of Mobara, Japan

[73] Assignee: Futaba Denshi Kogyo K.K., Mobara, Japan

[21] Appl. No.: 686,605

[22] Filed: Jul. 26, 1996

[30] Foreign Application Priority Data

Jul. 28, 1995 [JP] Japan ..... 7-211417

[51] Int. Cl.[6] ..... H01J 9/18

[52] U.S. Cl. ..... 445/25

[58] Field of Search ..... 445/24, 25, 3

[56] References Cited

U.S. PATENT DOCUMENTS 3,931,436 1/1976 Kupsky ..... 445/25 X 4,071,287 1/1978 Sherk ..... 445/25

4,906,311 3/1990 Guroi ..... 65/59.21

*Primary Examiner*—Kenneth J. Ramsey

*Attorney, Agent, or Firm*—Oblon, Spivak, McClelland, Maier & Neustadt, P.C.

[57] ABSTRACT

A vacuum airtight envelope capable of being manufactured in bulk and with increased yields. Cathode substrates and anode substrates are prepared by multisubstrate co-formation techniques. A cathode source plate is cut into a plurality of individual cathode substrates, which are mounted on an anode source plate by surface-mounting. Then, getter boxes are temporarily fixed on the anode source plate and then sealedly joined thereto together with cathode substrates. Then, the anode source plate is cut, to thereby provide individual envelopes, which are then evacuated to a vacuum.

3 Claims, 4 Drawing Sheets

VACUUM AIRTIGHT ENVELOPE AND METHOD FOR MANUFACTURING SAME

BACKGROUND OF THE INVENTION

This invention relates to a vacuum airtight envelope and a method for manufacturing the same, and more particularly to a vacuum airtight envelope including a glass substrate provided thereon with cathodes and a glass substrate provided thereon with anodes and a method for manufacturing the same.

Recently, vacuum microelectronics for integratedly mounting a vacuum microstructure of a size as small as microns having cold cathodes incorporated therein on a substrate made of a semiconductor while using semiconductor fine-processing techniques have come to notice in the art. The vacuum microelectronics are adapted to use high-speed characteristics of electrons, satisfactory orbit control or coherence characteritics thereof or the like in a vacuum to realize an active element resistant to a high temperature or a radiation environment or a high-function element utilizing coherence of electrons and it is considered to apply the vacuum microelectronics to a high-function element such as a high-definition flat-type display device, a sensor, a radiofrequency amplification element, a microwave element or the like.

Now, a vacuum airtight envelope in which such a high-function vacuum element is stored will be described hereinafter with reference to FIG. 4 showing a high-definition flat-type display device by way of example.

In FIG. 4, reference numeral 101 designates a cathode substrate made of glass or the like and 102 is cathodes formed on the cathode substrate 102. The cathodes 102 each may be in the form of a cold cathode such as a field emission cathode or the like. 103 is cathode terminals arranged on the cathode substrate 101, which function to connect the cathodes 102 and an external drive circuit to each other therethrough.

Also, reference numeral 104 designates an anode substrate and 105 is anodes formed on the anode substrate 104 for capturing electrons emitted from the cathodes 102. When the vacuum element is in the form of a display device, the anodes each have a phosphor layer deposited thereon. Reference numeral 106 is anode terminals arranged on the anode substrate 104 for connecting the anodes 105 and an external drive circuit to each other therethrough. The cathode substrate 101 and anode substrate 104 are arranged so as to ensure that the cathodes 102 and anodes 105 are positioned opposite to each other and the anode terminals 106 and cathode terminals 103 are prevented from overlapping the substrates opposite to each other, respectively. Also, the substrates 102 and 105 are sealedly joined to each other by means of frit glass 107 to provide an airtight envelope, which is then evacuated to a high vacuum, resulting in the vacuum airtight envelope being provided.

Now, manufacturing of such a vacuum airtight envelope will be described hereinafter.

First, a glass plate is cut into a predetermined size, to thereby provide the cathode substrate 101. Then, the cathode substrate 101 is subject to washing and drying and then formed thereon with the cathodes 102 and cathode terminals 103.

Likewise, the anode substrate 104 is prepared and then formed thereon with the anodes 105 and anode terminals 106.

Then, the frit glass 107 is arranged on any one of the cathode substrate 101 and anode substrate 104, which are then superposed on each other while being aligned with each other.

Subsequently, both substrates 101 and 104 are firmly held together by means of a fixture, to thereby be prevented from being displaced or deviated from each other and then placed in a heating oven for sealing. This results in the frit glass 107 being melted, so that both substrates 101 and 104 may be sealed together, to thereby provide the airtight envelope.

Thereafter, the envelope is evacuated through an evacuation section thereof to form a vacuum in the envelope, followed by hermetic sealing of the evacuation section.

Finally, the envelope is subject to getter flashing for adsorbing any gas remaining in the envelope to further enhance a vacuum in the envelope.

In the conventional method described above, the cathode substrate and anode substrate are prepared one by one. In order to increase manufacturing efficiency of the envelope, both substrates may be also manufactured by multisubstrate co-formation for simultaneously forming multiple substrates. More particularly, in place of the first and second steps in the conventional method described above, it is carried out to form patterns of a plurality of the cathode substrates or anode substrates on the glass plate increased in area, which is then cut into the cathode substrates or anode substrates according to the patterns. This permits the cathode substrates or anode substrates to be manufactured in bulk and at an increased speed.

The multisubstrate co-formation techniques described above require to subject the glass plate having the patterns formed thereon to cutting, although the techniques rapidly provide the substrates in bulk as described above. Cutting of the glass substrate leads to production of glass powders and/or chips, breakage of the substrates, tipping thereof, and the like, which often adversely affect the patterns formed on the glass plate. In manufacturing of the cathode substrates, such disadvantages may be eliminated by cutting the glass plate while keeping a resist coat applied to the glass plate. However, the glass plate for the anode substrates each have the phosphor layer previously deposited thereon, therefore, it is highly difficult to cut the glass plate while preventing the glass powders and/or chips from adversely affecting a surface of the glass plate, leading to a deterioration in yields of the anode substrates.

SUMMARY OF THE INVENTION

The present invention has been made in view of the foregoing disadvantage of the prior art.

Accordingly, it is an object of the present invention to provide a vacuum airtight envelope which is capable of being manufactured in bulk while ensuring an increase in yields thereof.

It is another object of the present invention to provide a method for manufacturing a vacuum airtight envelope which is capable of accomplishing mass production of a vacuum airtight envelope while keeping yields thereof at an increased level.

In accordance with one aspect of the present invention, a method for manufacturing a vacuum airtight envelope is provided. The method comprises the steps of cutting a cathode source plate into a plurality of individual cathode substrates separate from each other, carrying out surface-mounting of the cathode substrates on an anode source plate, sealedly joining the cathode substrates and the anode source plate to each other, cutting the anode source plate into a plurality of anode substrates separate from each other, to thereby provide individual envelopes separate from each other, and separately evacuating and sealing the envelopes.

In accordance with this aspect of the present invention, a method for manufacturing a vacuum airtight envelope is also provided. The method comprises the steps of cutting a cathode source plate into a plurality of individual cathode substrates separate from each other, carrying out surface-mounting of the cathode substrates on an anode source plate, carrying out sealed joining between the cathode substrates and the anode source plate to form a plurality of envelopes in a lump, evacuation of the envelopes and sealing of the envelopes, and cutting the anode source plate to separate the envelopes from each other.

In accordance with another aspect of the present invention, a vacuum airtight envelope is provided. The vacuum airtight envelope is manufactured according to each of the methods described above.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
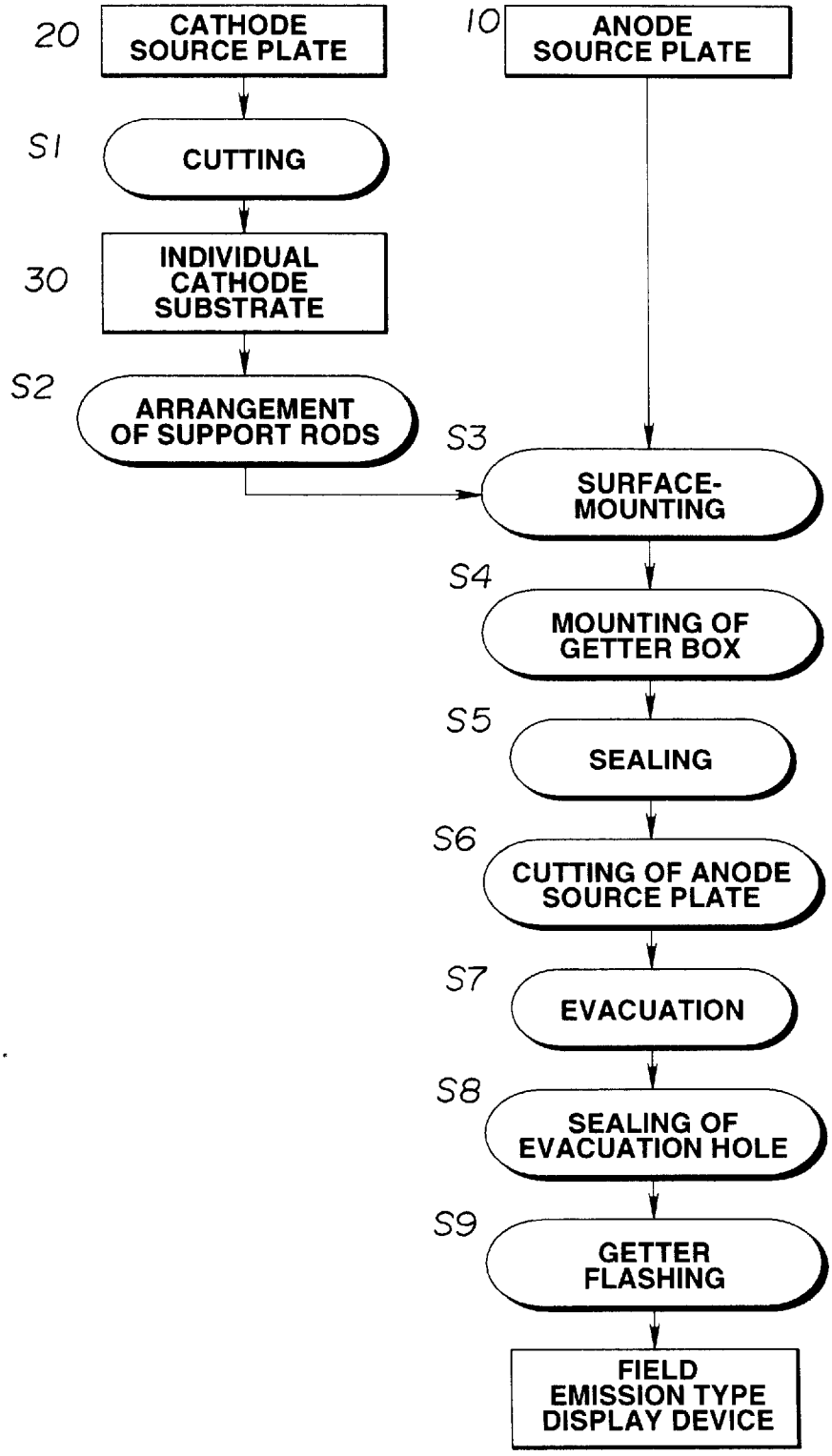
FIG. 1 is a flow chart showing an embodiment of a method for manufacturing a vacuum airtight envelope according to the present invention.

Now, the present invention will be described hereinafter with reference to FIGS. 1 to 3, wherein like reference numerals designate like or corresponding parts throughout.

Referring first to FIG. 1, an embodiment of a method for manufacturing a vacuum airtight envelope according to the present invention is illustrated in the form of a flow chart. In the present invention, both anode substrates and cathode substrates are provided by multisubstrate co-formation. In FIG. 1, reference numeral 10 designates a single anode source plate of an increased area of which multiple anode substrates are to be simultaneously made by cutting. The anode source plate 10 is formed thereon with anode patterns for a plurality of anode substrates. Reference numeral 20 is a single cathode source plate of an increased area of which multiple cathodes substrates are to be simultaneously made by cutting. Likewise, the cathode source plate 20 is formed thereon with cathode patterns for a plurality of cathode substrates.

The cathode source plate 20 is formed thereon with a resist coat and then separately cut into a plurality of individual cathode substrates 30 in a step S1, during which the resist coat prevents glass powders or the like produced due to the cutting from adversely affecting the cathode substrates 30.

Then, in a step S2, the cathode substrates 30 each are provided thereon with support rods. The support rods function to keep the cathode substrate and anode substrate spaced from each other at a predetermined interval against an atmospheric pressure applied thereto when the envelope is assembled. Alternatively, the support rods may be arranged on the anode source plate 10.

Thereafter, in a step S3, a plurality of the cathode substrates 30 each are arranged on each of the anode patterns on the anode source plate 10 while being aligned therewith and then separately subject to surface-mounting. The surface-mounting may be carried out by arranging frit glass on either the anode source plate 10 or each of the cathode substrates 30 and then subjecting a part of the frit glass to spot heating or the like to temporarily fix the plate 10 and cathode substrate 30 to each other.

Subsequently, in a step S4, a getter box is likewise temporarily fixed to each of the cathode substrates 30 thus temporarily secured to the anode source plate 10. The getter box has a getter arranged therein and is provided with an evacuation hole. Such mounting of the getter box provided with the exhaust hole on the cathode substrate 30 eliminates a necessity of forming the cathode substrate 30 or anode source plate 10 with any hole for evacuation. This effectively prevents powders, chips or the like produced due to formation of such a hole at the cathode substrate or anode source plate from adversely affecting manufacturing of the vacuum airtight envelope.

Figure 2:
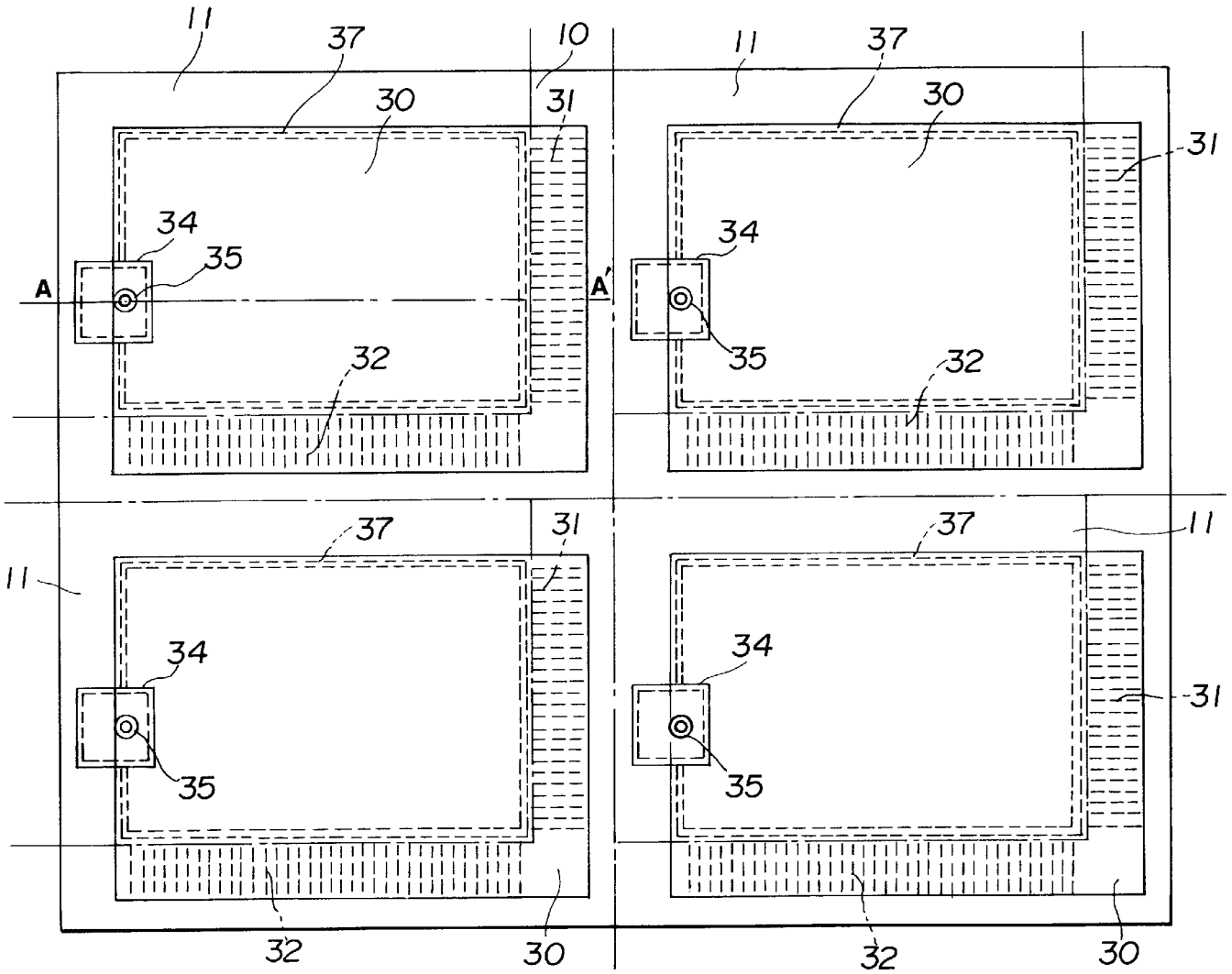
FIG. 2 is a schematic view showing one of steps in the method shown in FIG. 1.

FIG. 2 shows an intermediate structure of the vacuum airtight envelope after termination of the step S4. In FIG. 2, reference numerals 10 and 30 designate the anode source plate and individual cathode substrates described above, respectively, 31 is cathode terminals provided on each of the cathode substrates 30, 32 is gate terminals arranged on the cathode substrate 30, 34 is a getter box provided for every cathode substrate 30, 35 is an evacuation hole provided at the getter box 34, and 37 is frit glass.

In FIG. 2, the anode source plate 10 is formed into a size sufficient to provide four anode substrates.

Also, in FIG. 2, dashed lines indicate cutting lines along which the anode source plate 10 is cut. Segments 11 surrounded by the dashed lines each provide an anode substrate. The cathode substrates 30, as shown in FIG. 2, each are arranged so as to be superposed on the individual anode substrates 11 while being deviated therefrom in a predetermined manner. Such arrangement of the cathode substrates 30 and anode substrates 11 prevents the cathode terminals 31 and gate terminals 32 arranged on the cathode substrate 30 from being superposed on the anode substrate 11 to fail in connection of the cathode terminals 31 and gate terminals 32 to the external circuits.

The getter box 33 is arranged so as to extend to both anode substrate 11 and cathode substrate 30.

Figure 3:
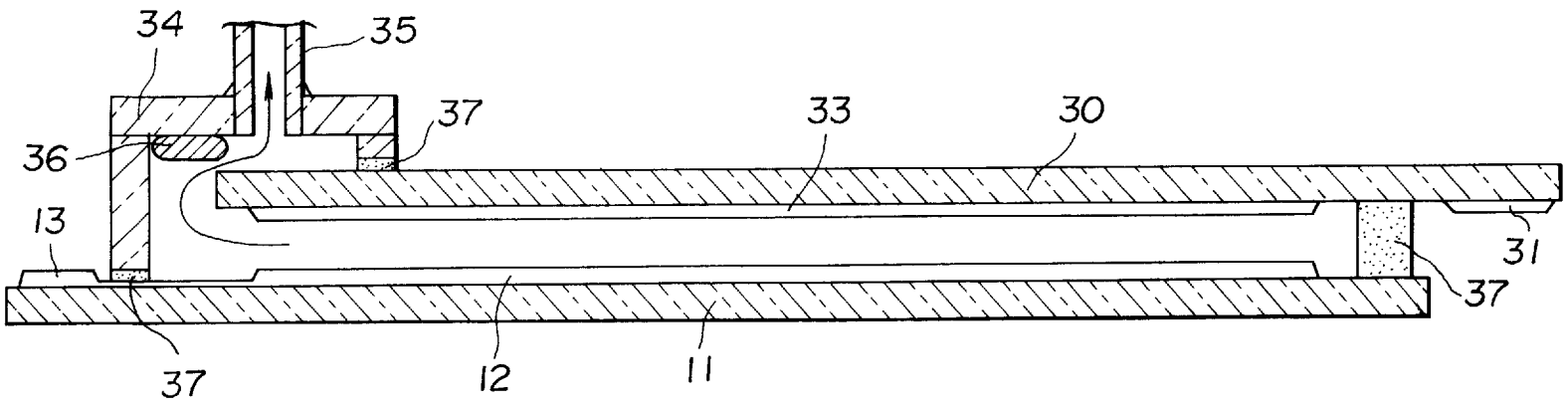
FIG. 3 is a schematic sectional view showing a vacuum airtight envelope according to the present invention.
Figure 4:
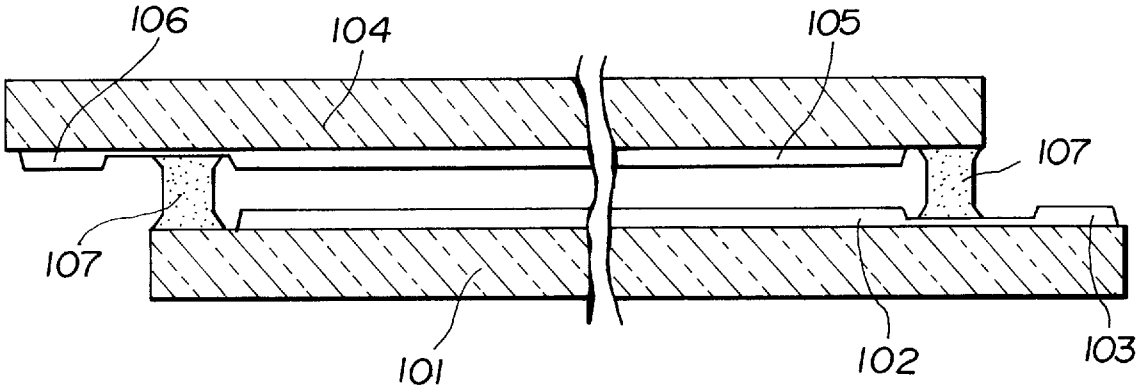
FIG. 4 is a sectional view showing a conventional vacuum airtight envelope.

FIG. 3 is a sectional view taken along line A-A' of FIG. 2. In FIG. 3, reference numeral 11, as described above, designates the anode substrate, 12 is anodes formed on the anode substrate 1, 13 is anode terminals, 30 is the cathode substrate, 33 is cathodes, and 31 is cathode terminals. 34 is the getter box described above, 35 is the exhaust hole described above, 36 is a getter, and 37 is frit glass.

In the steps S3 and S4 described above, the cathode substrate 30 and getter box 34 are positioned and temporarily mounted on the anode source plate 10, as shown in FIGS. 2 and 3.

Subsequently, in a step S5, the anode source plate 10 having the four cathode substrates 30 and four getter boxes 34 temporarily fixed at predetermined positions thereon is placed in a sealing oven such as an electric oven, resulting in the cathode substrates 30 and getter boxes 34 being sealedly joined to the anode source plate 10. More particularly, heating of the anode source plate 10 in the sealing oven permits the frit glass of a low melting point to be melted, so that sealed joining between the anode source plate 10 and the cathode substrates 30 and that between the anode source plate 10 and the getter box 34 may be concurrently carried out.

Then, a step S6 is executed, wherein the anode source plate 10 is subject to cutting. More particularly, the anode source plate 10 is cut along dashed lines indicated in FIG. 2, to thereby provide the individual anode substrates 11 described above. The anode substrate 11 and cathode substrate 30, as described above with reference to FIG. 2, are superposed on each other while being deviated from each other. Thus, a portion of the anode source plate 10 wherein the cutting line of the dashed lines is exposed as viewed from may be cut from a side of the cathode substrate 30, whereas a portion of the anode source plate 10 wherein the cutting line of the dashed lines is positioned below the cathode substrate 30 is cut from a side of the anode source plate 10.

Thus, the illustrated embodiment is so constructed that the cathode substrates 30 and getter boxes 34 are sealedly joined to the anode source plate 10 in the step S5 and then cutting of the anode source plate 10 is carried out in the step S6. Such construction effectively prevents glass powders and/or chips produced due to cutting of the glass source plate from adhering to the anodes or entering the envelope, to thereby keep yields of the envelope from being deteriorated.

Thus, the step S6 provides the individual envelopes separate from each other and thereafter a step S7 is executed for evacuation of each of the envelopes. More particularly, the evacuation is carried out through the evacuation hole 35 provided at the getter box 34, so that air may be outwardly discharged from a space defined between the anode substrate 11 and the cathode substrate 30 as indicated at an arrow in FIG. 3.

Then, a step S8 is carried out, wherein the exhaust hole 35 of each of the getter boxes 34 is sealedly closed, so that an interior of the envelope may be kept at a vacuum.

Thereafter, getter flashing is carried out in a step S9. This may be executed by flashing the getter 37 such as barium or the like received in each of the getter boxes 34 by high frequency induction heating. This permits a deposited film of metal barium to adsorb any gas remaining in the envelope, to thereby keep the interior of the envelope at a higher vacuum level.

This results in a field emission type display device received in the vacuum airtight envelope being provided.

In the embodiment described above, the cutting is carried out in the step S6 following the sealing in the step S5. Alternatively, the embodiment may be practiced so that the evacuation in the step S7 and sealing of the evacuation hole in the step 8 may be continuously executed following the sealing in the step S5. In this instance, the cutting in the step S6 is carried out following continuous execution of the steps S7 and S8. Thus, the steps S5, S7 and S8 are continuously carried out at the same stage and then the steps S6 and S9 are executed in order. Such modification likewise prevents cutting of the glass source plate from adversely affecting the envelope.

The above description has been made in connection with manufacturing of the field emission type display device by way of example. However, it is a matter of course that the present invention is not limited to this case. The present invention is effectively applied to a vacuum airtight envelope for any other device.

As can be seen from the foregoing, in the present invention, multisubstrate co-formation for simultaneously forming multiple anode substrates is employed. Thus, the present invention permits the vacuum airtight envelope to be manufactured in bulk. Also, the present invention is so constructed that cutting of the anode source plate is carried out following the sealing step. Such construction effectively prevents cutting of the anode source plate from adversely affecting the envelope, leading to mass-production of the envelope and an improvement in yields thereof.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for manufacturing a vacuum airtight envelope, comprising the steps of:

cutting a cathode source plate into a plurality of individual cathode substrates separate from each other;

carrying out surface-mounting of said cathode substrates on an anode source plate;

sealedly joining said cathode substrates and said anode source plate to each other;

cutting said anode source plate into a plurality of anode substrates separate from each other, to thereby provide individual envelopes separate from each other; and separately evacuating and sealing said envelopes.

2. A method for manufacturing a vacuum airtight envelope, comprising the steps of:

cutting a cathode source plate into a plurality of individual cathode substrates separate from each other;

carrying out surface-mounting of said cathode substrates on an anode source plate;

carrying out sealed joining between said cathode substrates and said anode source plate to form a plurality of envelopes in a lump, evacuation of said envelopes and sealing of said envelopes; and cutting said anode source plate to separate said envelopes from each other.

3. A vacuum airtight envelope manufactured according to a method defined in claims 1 or 2.

* * * * *